US011578941B2

(12) United States Patent
Hart

(10) Patent No.: US 11,578,941 B2
(45) Date of Patent: Feb. 14, 2023

(54) BARREL SLEEVE ASSEMBLY

(71) Applicant: Kemlin Hart, Mason City, IA (US)

(72) Inventor: Kemlin Hart, Mason City, IA (US)

( * ) Notice: Subject to any disclaimer, the term of this patent is extended or adjusted under 35 U.S.C. 154(b) by 0 days.

(21) Appl. No.: 16/929,776

(22) Filed: Jul. 15, 2020

(65) Prior Publication Data

US 2020/0348099 A1 Nov. 5, 2020

Related U.S. Application Data

(63) Continuation-in-part of application No. 14/593,096, filed on Jan. 9, 2015, now abandoned.

(60) Provisional application No. 61/933,017, filed on Jan. 29, 2014.

(51) Int. Cl.
*F41A 21/02* (2006.01)

(52) U.S. Cl.
CPC ..... *F41A 21/02* (2013.01)

(58) Field of Classification Search
CPC ..... F41A 21/02; F41A 21/04; F41A 21/10; F41A 35/02; F41A 35/04; B21C 37/152; B21C 37/153; B23B 41/02
USPC ..... 42/76.01, 76.1, 77, 78; 89/14.1, 14.2, 89/14.3, 14.4, 14.5, 14.6, 14.7, 14.8
See application file for complete search history.

(56) References Cited

U.S. PATENT DOCUMENTS 2,137,259 A * 11/1938 Boak ..... F41A 21/02 42/76.02
2,249,899 A * 7/1941 Hogg ..... F41A 21/02 42/76.01
4,123,866 A * 11/1978 Wiethoff ..... F41A 21/10 42/51
4,911,060 A * 3/1990 Greenspan ..... F41A 21/02 42/76.02
5,222,295 A * 6/1993 Dorris, Jr. ..... F02F 7/00 29/402.09
5,856,631 A * 1/1999 Julien ..... F41A 21/20 89/16
6,266,908 B1 * 7/2001 Spencer ..... F41C 3/14 42/78
8,353,124 B1 * 1/2013 Zukowski ..... F41C 3/14 42/76.02
2007/0193102 A1 * 8/2007 Briggs ..... F41A 21/02 42/76.02
2008/0120889 A1 * 5/2008 Bose ..... F41A 21/18 42/76.02
2009/0049732 A1 * 2/2009 Kissinger ..... F41A 13/10 42/106
2011/0265365 A1 * 11/2011 Alonso Tricio ..... F41A 21/18 42/78
2013/0036902 A1 * 2/2013 Adolphsen ..... F41A 5/26 89/193
2019/0310044 A1 * 10/2019 Glisovic ..... F41A 21/02

* cited by examiner

*Primary Examiner* — Bret Hayes
(74) *Attorney, Agent, or Firm* — Zarley Law Firm, P.L.C.

(57) ABSTRACT

The present invention relates to a barrel sleeve assembly for a rifle. The barrel sleeve assembly includes a rifle barrel and a sleeve. The rifle barrel has a portion that has been turned down from standard sizes. The sleeve is fitted over the turned down portion of the rifle barrel.

8 Claims, 2 Drawing Sheets

BARREL SLEEVE ASSEMBLY

CROSS REFERENCE TO RELATED APPLICATION

This application is a continuation-in-part of U.S. Ser. No. 14/593,096 filed Jan. 9, 2015 which claims the benefit of the priority of U.S. Provisional Application No. 61/933,017 filed on Jan. 29, 2014, the contents of these applications are hereby incorporated by reference in their entirety.

BACKGROUND OF THE INVENTION

This invention is directed to a barrel sleeve assembly, and more particularly a barrel sleeve assembly for a standard rifle.

Standard rifle barrels are known in the art. Not only are these barrels heavy, but they can become hot. As an example, when target shooting, due to heat in the barrel, the point of impact can change affecting accuracy. It is difficult to lighten and cool a barrel while maintaining rigidity for accuracy. The use of alloy sleeve through thermodynamics can remove heat from the barrel twelve times faster than steel while still providing the strength needed to maintain accuracy. Therefore, a need exists in the art for a device that addresses these needs.

An objective of the present invention is to provide a barrel sleeve assembly that is lighter.

A further objective of the present invention is to provide a barrel sleeve assembly that acts as a heat sink.

A still further objective of the present invention is to provide a barrel sleeve assembly that maintains rigidity.

SUMMARY OF THE INVENTION

The present invention relates to a barrel sleeve assembly for a rifle. The barrel sleeve assembly includes a rifle barrel and a sleeve. The rifle barrel has a portion that has been turned down from standard sizes. The sleeve is fitted over the turned down portion of the rifle barrel.

The sleeve can be made of a light weight metal or metal with high heat conductivity, or both. The sleeve is fitted over the rifle barrel with a low tolerance between the sleeve's inner diameter and the rifle barrel's outer diameter.

In some embodiments the rifle barrel has a threaded portion that engages a threaded inner surface of the sleeve. In other arrangements, the rifle barrel is coated with a bonding agent.

DETAILED DESCRIPTION OF THE PREFERRED EMBODIMENTS

Figure 1:
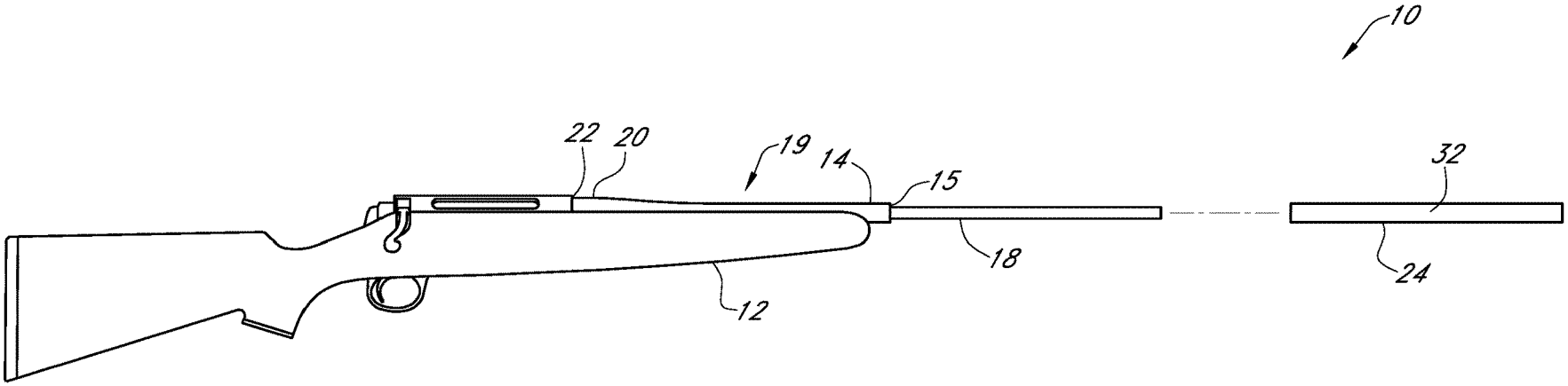
FIG. 1 is a exploded view of a barrel sleeve assembly.
Figure 2:
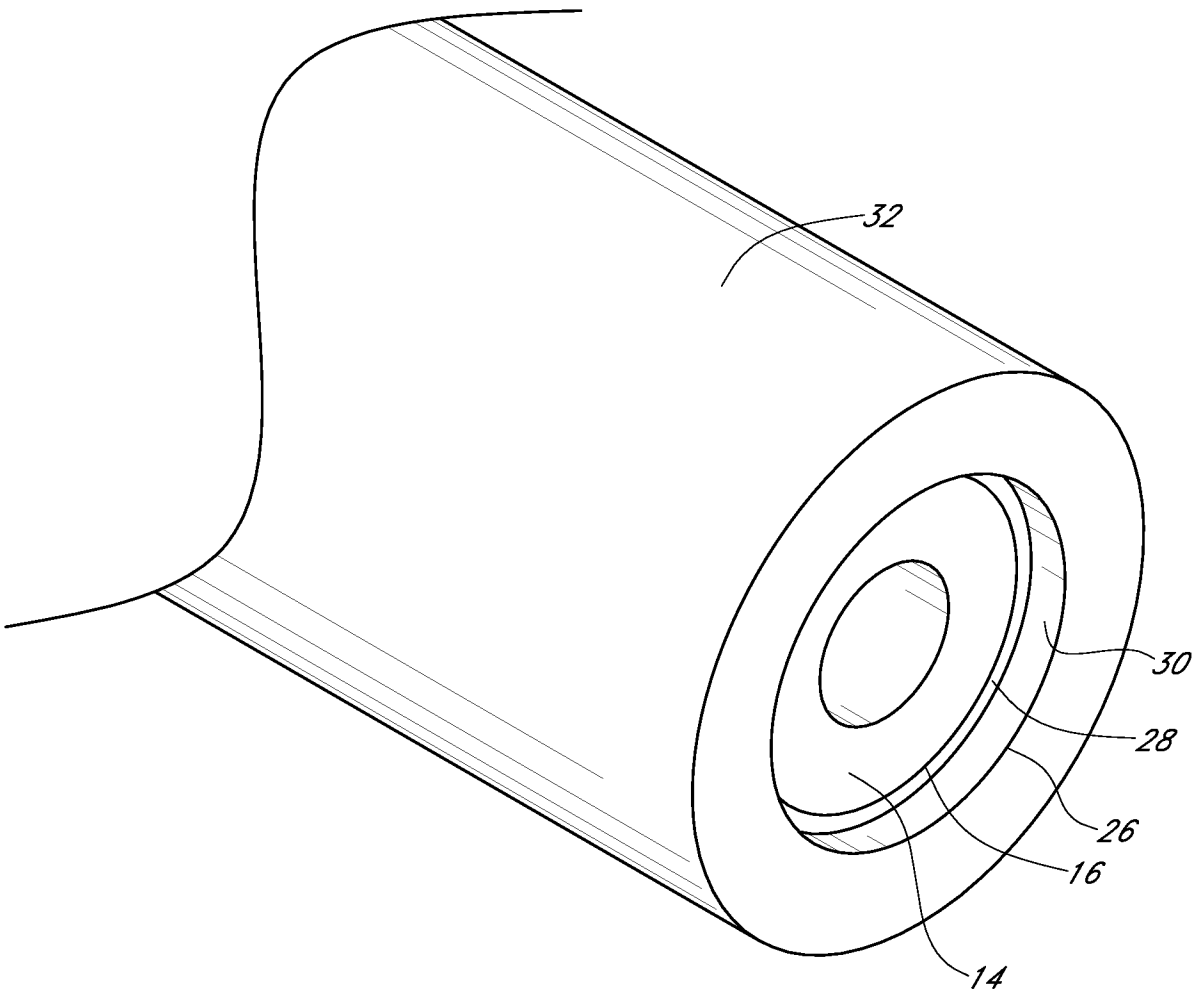
FIG. 2 is a perspective view of the end of a barrel sleeve assembly.

Referring to the Figures, a barrel sleeve assembly 10 includes a rifle 12 having a rifle barrel 14 where the outside diameter 16 of the rifle barrel 14 has been turned down to form a turned down portion 18. In one example, the outside diameter 16 is turned down to between 0.500 inches to 0.750 inches from standard dimensions. At least one end 20 of the rifle barrel 14 is threaded to form a threaded portion 22. Alternatively, the entire length of the rifle barrel 14 or any portion thereof is threaded. In another embodiment, no portion of the rifle barrel 14 is threaded.

Attached to the rifle barrel 14 is a sleeve 24. The sleeve 24 is preferably made of aluminum or another metal that with high heat conductivity and is cut to match the length of turned down portion 18 of the rifle barrel 14. Preferably a 6000 series alloy having magnesium and silicon is used as this alloy is cost effective and still provides the strength needed to maintain accuracy. A 7000 alloy can also be used, but it is less cost effective. In alternative embodiments the sleeve 24 is shorter or longer than the turned down portion 18 of the rifle barrel 14. The sleeve 24 preferably has an inner diameter 26 that is close in tolerance, between 0.000 inches-0.010 inches, with the outer diameter 16 of turned down portion 18 the rifle barrel 12. Ideally, the tolerance is approximately 0.003 of an inch. The tolerance is critical as it needs to be large enough to slide onto the barrel 12, yet tight enough that the sleeve 24 and the barrel 12 will bond. The sleeve 24 is attached to the rifle barrel 12 in any manner and preferably is attached using a bonding agent 28. The bonding agent 28 is of any type and can be an anaerobic type that will seal in an oxygen-free environment. In one embodiment, the bonding agent 28 is of high strength that is capable of taking heat of 400° F. or greater and a 3,000 PSI. In other embodiments the bonding agent 28 has a high heat transfer. Examples of possible bonding agents 28 include a bearing retainer LOC and a two part plastic epoxy. Ideally, Vibra-Tite® 56725, a high temperature retaining compound is used. The bonding agent fills any gap that exists between the barrel 12 and the sleeve 24.

To assemble, the outside diameter 18 of the rifle barrel 14 is turned down from standard dimensions to form the turned down portion 18. As seen in FIG. 1, the process of turning down the rifle barrel 14 forms an end 15 on a portion of the rifle barrel 14 extending substantially perpendicularly between the a standard dimension 19 and the turned down portion 18 of the rifle barrel 14. A sleeve 24 is then cut to the correct length and diameter to ensure proper application and cured. At least one end 20 of the rifle barrel 14 is threaded to form a threaded portion 22. Alternatively, the threaded portion 22 can cover the entire length of the rifle barrel 12. An internal surface 30 of the sleeve 24 is threaded so that the rifle barrel 14 and sleeve 24 matingly engage. Next the turned down portion of the rifle barrel 14 is coated in a bonding agent 28 and the sleeve 24 is then fitted over the rifle barrel 14. Finally, the assembly 10 is placed under tension to eliminate any sag.

In one arrangement, when the sleeve 24 is fitted over the rifle barrel 14, an outer surface 32 of the sleeve 24 is flush with the outside diameter 16 of the rifle barrel 14. In alternative arrangements, the outer surface 32 of the sleeve 24 is lower or higher than the outside diameter 16 of the rifle barrel 14.

Therefore, a barrel sleeve assembly 10 has been provided that is lighter, acts as a heat sink, maintains rigidity, and improves upon the art. The use of a sleeve 24 made of an alloy having magnesium and silicon bonded to the barrel 12 under pressure produces greater flow and accuracy, a barrel that more efficiently disburses heat, is strong when cured, does not require air flow, and is free of pockets.

From the above discussion and accompanying figures and claims it will be appreciated that the barrel sleeve assembly 10 offers many advantages over the prior art. It will also be appreciated by those skilled in the art that other modifications could be made without parting from the spirit and scope of the invention and fall within the scope of the claims and are intended to be covered thereby.

What is claimed is:

1. A barrel sleeve assembly comprising:

a rifle barrel having a turned down portion that is turned down a consistent diameter for the entire length of the turned down portion;

a sleeve fitted over only the turned down portion of the rifle barrel; and a bonding agent is applied between the sleeve and the turned down portion of the rifle barrel;

wherein the bonding agent is anaerobic;

wherein the sleeve is made of a 6000 series alloy of magnesium and silicon.

2. The barrel sleeve assembly of claim 1 further comprising the rifle barrel having a threaded portion that matingly engages an inner surface of the sleeve.

3. The barrel sleeve assembly of claim 1 wherein the turned down portion is turned down to between 0.500 inches to 0.750 inches from standard dimensions.

4. The barrel sleeve assembly of claim 1 wherein an inner diameter of the sleeve is between 0.000 inches and 0.010 inches of tolerance of an outer diameter of the turned down portion of the rifle barrel.

5. The barrel sleeve assembly of claim 1 wherein the rifle barrel and sleeve weigh less than the rifle barrel prior to being turned down.

6. The barrel sleeve assembly of claim 1 wherein the bonding agent has a high heat tolerance of at least 400° F.

7. The barrel sleeve assembly of claim 1 wherein a tolerance is 0.003 inches.

8. The barrel sleeve assembly of claim 1 wherein the bonding agent has a strength of 3000 PSI.

* * * * *